US007455080B2

(12) United States Patent
Crittenden et al.

(10) Patent No.: US 7,455,080 B2
(45) Date of Patent: Nov. 25, 2008

(54) MANUAL TENSIONER FOR NON-METALLIC STRAPS

(75) Inventors: David E. Crittenden, Schaumburg, IL (US); Janusz Figiel, Mundelein, IL (US); Michael W. Freeman, Park Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 396 days.

(21) Appl. No.: 11/307,180

(22) Filed: Jan. 26, 2006

(65) Prior Publication Data

US 2007/0169833 A1 Jul. 26, 2007

(51) Int. Cl.
*B21F 9/00* (2006.01)

(52) U.S. Cl. ..... 140/123.5; 140/123.6; 140/153

(58) Field of Classification Search ..... 140/93.2, 140/93.4, 123.5, 123.6, 152, 153, 154; 100/29, 100/32, 33 PB; 53/592; 254/216, 217
See application file for complete search history.

(56) References Cited

U.S. PATENT DOCUMENTS 3,844,317 A 10/1974 Angarola et al.
3,858,625 A 1/1975 Banjeglav
3,998,429 A 12/1976 Cheung
4,252,158 A * 2/1981 McDade ..... 140/123.6
5,133,532 A * 7/1992 Figiel et al. ..... 254/216
6,079,456 A * 6/2000 Drabarek et al. ..... 140/93.2
6,640,838 B2 * 11/2003 Finzo ..... 140/93.2

FOREIGN PATENT DOCUMENTS

EP 0510982 10/1992
GB 1507230 4/1978

OTHER PUBLICATIONS

EP Search Report for EP1813531.

* cited by examiner

*Primary Examiner*—Edward Tolan
(74) *Attorney, Agent, or Firm*—Mark W. Croll; Donald J. Breh; Levenfeld Pearlstein, LLC

(57) ABSTRACT

A tensioner is disclosed for applying a non-metallic strap around a load. The tensioner includes a base and a lever that can pivot. A drive gear is mounted to the lever and rotates clockwise. A tension gear engages the drive gear and rotates counter-clockwise. A feed wheel is coupled to the tension gear and rotates counter-clockwise. A gripper is attached to the base. The strap is held stationary by the gripper, wrapped around the load, is fed underneath and is in contact with the feed wheel. When the lever is rotated down, the feed wheel rotates counter-clockwise. The strap is pulled toward a distal end of the tensioner and is tensioned in a clockwise direction around the load.

19 Claims, 6 Drawing Sheets

MANUAL TENSIONER FOR NON-METALLIC STRAPS

BACKGROUND OF THE INVENTION

The present invention relates to a manual tensioner with a cutter that may be used to apply a non-metallic strap around a load and to cut the strap from a strap supply.

Straps are wrapped around loose objects, such as lumber, to bind the objects together. Straps are also wrapped around boxes and other items to package and secure the boxes and items together. Straps of different materials are often used to tighten different types of loads. For example, plastic straps are often used to tighten lumber loads and boxes. Tensioners are used to tighten or tension the straps around the load. Further, there are tensioners designed for metallic straps and others for plastic or non-metallic straps. A hand-held or manual tensioner is typically used when a load is to be tightened in the field, such as the one shown in FIG. 1.

Non-metallic hand held tensioners of the art are able to tighten the strap around the load, but they suffer from many shortcomings. For example, after wrapping the strap around the load, it is desirable to manually pull the strap to remove any excess slack. This typically reduces the time and number of steps required to complete a strapping operation, i.e., to tighten the strap around the load. However, prior art tensioners used with non-metallic straps incorporate gear box assemblies that either did not allow for manual slack reduction or incorporated very cumbersome slack reduction mechanisms. In other words, after the strap is wrapped around the load and fed into the tensioner, the user either cannot pull an end of the strap to manually remove excess slack or cannot remove excess slack without exerting great effort.

In addition, other tensioners of the art incorporate a double strap or a strap-on-strap loading mechanism. A first portion of the strap is held in place by a gripper, and a down stream portion of the strap is wrapped around the load and positioned over the first portion. This forms a top strap layer, and the portion of the strap underneath the top layer is the bottom layer. A feed wheel pushes down over the top layer.

A lever 12 of the tensioner 10 (FIG. 1) is rotated downward to actuate the gear system of the tensioner and begin the tightening or tensioning process. These tensioners incorporate a single ratchet gear system where the ratchet gear is rotatably mounted to the lever 12. The feed wheel is coupled to the ratchet gear by a shaft so that, when the lever is pushed down, the ratchet gear and the feed wheel turn clockwise. The feed wheel is in frictional contact with and pulls and/or tensions the strap around the load when it rotates. Specifically, the strap is tensioned or pulled toward a proximal end 14 of the tensioner 10, away from a distal 16 end of the lever 12, which extends toward a distal end 18 of the tensioner 10.

In sum, the feed wheel rotates clockwise and the strap is tensioned away from a distal end of the lever and tensioner 16, 18. This causes a force distribution on the tensioner 10 and strap that tends to cause the feed wheel assembly to "open up." In other words, when the strap is subject to high tension forces and the lever 12 is pushed down, the tensioner tends to tilt upward, causing the feed wheel to apply a weaker downward force on the strap. As a result, the strap may slip from the feed wheel and/or the feed wheel may mill or shear top portions of the plastic strap off. To counteract the opening-up phenomenon, the user must exert additional downward force on the tensioner 10 to prevent strap slippage and/or milling. Applying the additional downward force will prematurely tire the user.

To alleviate these problems, a different tensioner adopted a single strap design where a first end of a plastic strap was placed on a gripper having a bottom surface and a pivoting top surface. The first end of the plastic strap is placed on the bottom surface, and the top surface is pivoted and forced down over the bottom surface by way of a spring mechanism.

A downstream portion of the strap is wrapped around the load and slotted into a windlass. Specifically, the lever is attached to a ratchet gear, and the ratchet gear is coupled to the windlass by a shaft. When the lever is pushed down, the ratchet gear rotates, causing both the shaft and the windlass to rotate. The strap is wound around the windlass.

The gripper does not "energize" or clamp into the strap as well as a feed wheel when the strap is very tight or subject to high tensile forces. As a result, the strap may slip within the gripper and/or mill or be sheared by the gripper. Because the gripper comprises two different surfaces that are pressed upon each other, the top surface may not lie evenly flat over the bottom surface, causing one row of gripper teeth to be in closer contact with the strap than the other row. This also causes milling.

Further, tensioners using windlasses require greater forces to tighten the strap around the load, the tighter the strap is wound around the load. The reason is that the mechanical advantage of the tensioner decreases as the radius from the center of the windlass to the outermost strap wrapped around the windlass increases. As the strap is tightened around the load, additional strap revolutions are wound up around the windlass, causing the radius from the windlass center to the outermost strap to increase. A decreased mechanical advantage is the result.

After the strap is tensioned around the load, a separate sealing tool is used to crimp a sealing clip around the bottom and top strap layers to seal the layers together. The clips often include a body portion about as wide as the strap and two arms that depend from the edges of the body. The body of the seal is positioned atop the strap and, ideally, the arms of the seal should depend below the bottom strap. In this manner, the sealing tool can crimp the arms together below the bottom strap. However, the bottom and top strap layers often lay flush against the load, causing the arms of the sealing clip to abut the edges of the strap layers instead of depending below them. As a result, a user often inadvertently crushes the edges of the strap when crimping the arms of the clip.

One end of the plastic strap is typically cut after the seal is applied. Many known tensioners include cutters to cut the strap, but the cutters are difficult to use. Some cutters require the user to completely remove the tensioner from the sealed strap, and others increase the risk of inadvertently cutting the strap before the seal is applied. For example, some tensioners incorporate a cutter that is positioned toward a distal end of the tensioner and is actuated when the lever is pushed down beyond a breaking point. The problem is that the lever is also pushed down to tighten or tension the strap around the load, and a great deal of force must be applied to the lever to tighten the strap. Thus, the lever can be inadvertently pushed down beyond the breaking point before the seal is applied, causing the blade to prematurely cut the strap. This would require a user to start the strapping process again.

Tensioners of the art also were manufactured from one piece gearboxes that made disassembly very cumbersome and difficult. In addition, the gear box assembly incorporated springs that acted against various gearbox components, also making disassembly and reassembly of the gear box difficult.

As a result, there still exists a need for an apparatus and method for an improved manual tensioner that can be used to tighten a non-metallic strap around a load.

BRIEF SUMMARY OF THE INVENTION

The present invention pertains to a manual tensioner that is used to tighten or tension a non-metallic strap around a load. Pursuant to an embodiment of the invention, a first end of a strap is positioned in front of the tensioner, and a downstream portion of the strap is fed underneath a feed wheel and positioned over a gripper, which is attached to a base of the tensioner. The gripper holds the strap in place at a gripping point, down stream from the first end. A portion of the strap farther downstream is wound around the load, is fed underneath the feed wheel, and overlies the first end. The portion of the strap that overlies the first end is the top strap layer, and the portion of the strap that lies beneath the upper layer is the bottom strap layer. The strap may or may not be connected to a strap dispenser.

A user presses the lever down to drive the gear system and to begin tensioning the strap around the load. The lever generally pivots about a point near the proximal end of the tensioner and has a gripping portion or distal end that is in proximity to a distal end of the tensioner. According to a first embodiment of the invention, the tensioner incorporates a double gear system, which allows the strap to be tensioned in a clockwise direction around the load. In other words, the strap is tensioned or pulled toward a distal end of the lever and the tensioner, which results in the tensioner and feed wheel applying a greater downward normal force to the strap. Unlike prior art tensioners, the feed wheel effectively presses down on the strap when the strap is tightly wound around the load. Thus, strap slippage and milling are reduced and, in many instances, are completely eliminated. According to a second embodiment of the invention, the tensioner incorporates a selective locking mechanism to facilitate slack removal. The selective locking mechanism includes a ring-pawl assembly and a groove formed on the shaft. The ring-pawl assembly includes a ring that presses the pawl down against the shaft, and the shaft couples the feed wheel to the tension gear. An upper portion of the pawl interlocks with a notch formed in the tension gear. A lower portion of the pawl cooperates with the groove formed in the shaft. The pawl and grooves are shaped to permit the shaft to rotate in one direction with respect to the pawl, while the pawl remains stationary. Thus, when a user pulls the strap to remove excess slack, the feed wheel rotates, which causes the shaft to rotate. Because the shaft may rotate without causing the pawl to rotate, the tension gear, which is interlocked with the pawl, remains stationary when slack is removed from the strap and the shaft rotates. The user can, therefore, tighten the strap around the load in a shorter time by manually removing excess slack before tightening the strap around the load using the tensioner.

According to a third embodiment of the invention, a gearbox of the tensioner can be disassembled so that the gears and/or feed wheel are easily accessible. According to a fourth embodiment of the invention, a spring used to apply a downward force on the feed wheel and the strap is positioned outside the gear box, reducing the number of parts and complexity of the gear box. As a result, the gear box and parts within can be disassembled and reassembled with greater ease.

According to a fifth embodiment of the invention, a sealing flange protrudes upward from a cutting block body, creating space between the load and the upper and lower strap layers. As a result, a sealing clip can be applied so that the arms of the sealing clip depend below the strap. The arms can then easily be crimped around the bottom strap, instead of potentially crushing the edge of the strap if the cutting block were flat, as in prior art tensioners.

According to a sixth embodiment of the invention, a cutting blade is positioned at a proximal end of the tensioner. The cutting blade is activated by turning the lever of the tensioner toward a proximal end of the tensioner a predetermined number of radians to a cutting point, when a portion of the lever contacts the cutting blade assembly. The lever is turned beyond the cutting point and urges the cutting blade down to cut the strap. By positioning the cutting blade at the front of the tensioner, it remains easy to utilize the cutting blade for cutting purposes while reducing inadvertent, premature strap cuts, which were prevalent in tensioners incorporating cutting blades positioned toward a distal end of the tensioner.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
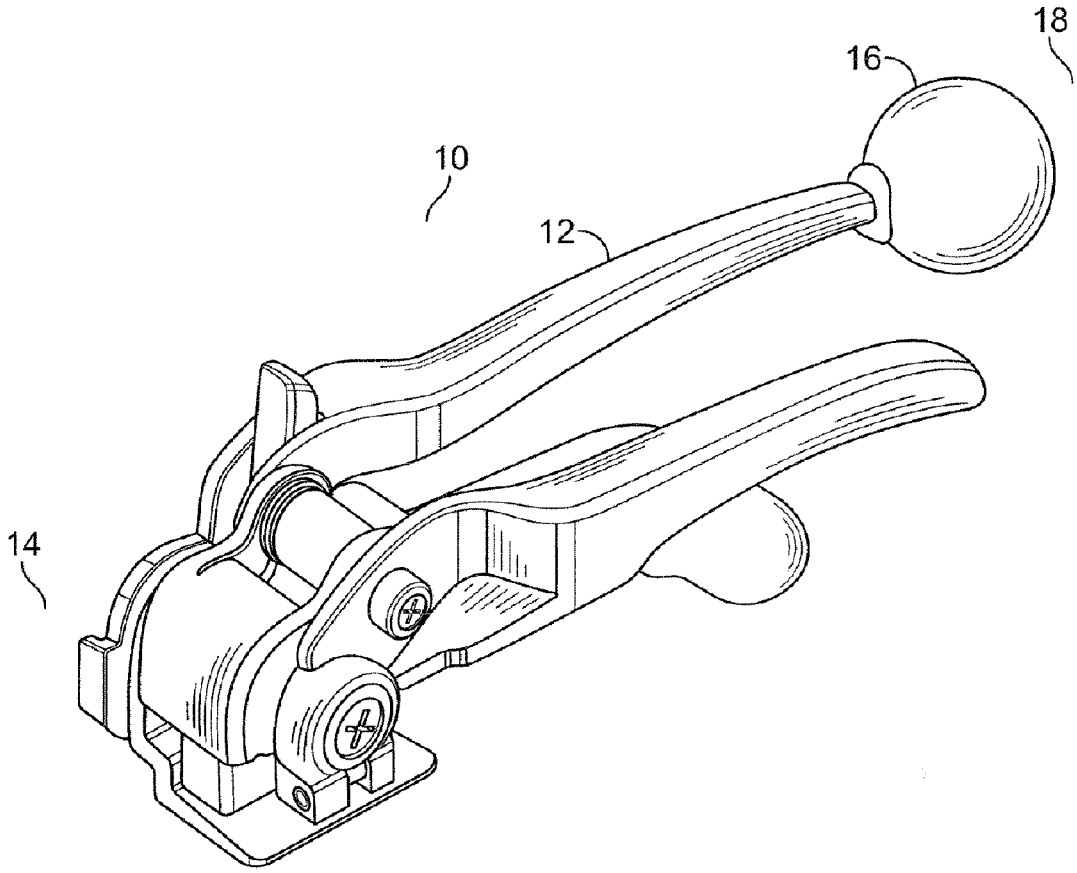
FIG. 1 (Prior Art)
FIG. 1 shows an isometric view of a first prior art tensioner.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
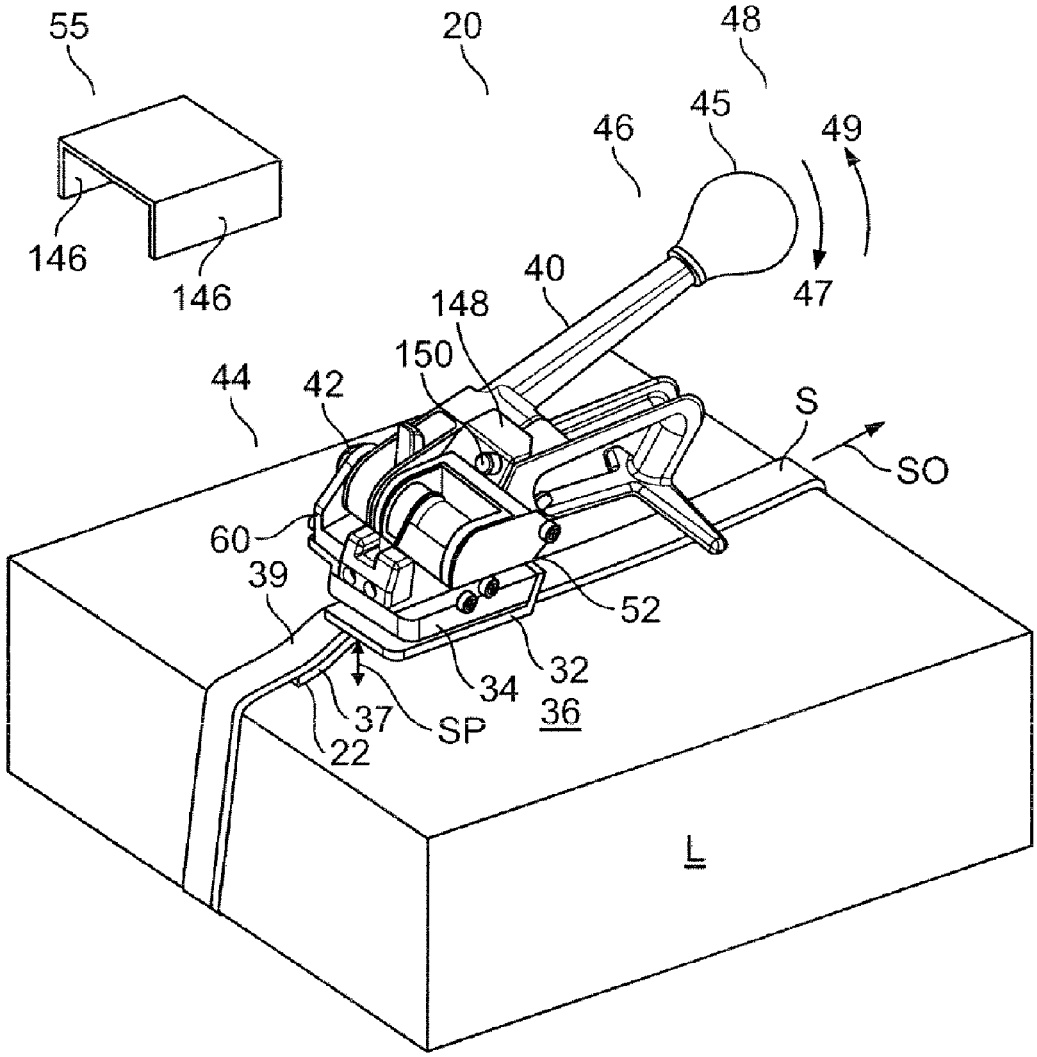
FIG. 2 shows an isometric view of a tensioner pursuant to several embodiments of the invention that is tensioning a non-metallic strap around a load.

The present invention pertains to a manual tensioner 20 that is used to tighten or tension a non-metallic strap S around a load L, as shown in FIG. 2. FIG. 2 shows an embodiment of the invention in which a first end 22 of the strap S is positioned atop the load L and in front of the tensioner 20. The strap S is inserted through a lower slot 24 formed by a strap separator 26 in a cutting block plate 28 (FIGS. 3 and 6), fed beneath a feed wheel 30 (FIG. 3), and positioned over a gripper 32, which is attached to a base 34 of the tensioner 20. The gripper 32 holds the strap S in place at a gripping point 36, down stream from the first end 22. This forms a bottom strap layer 37. Another downstream portion of the strap S is wound around the load L, placed over the bottom layer 37, inserted through an upper slot 38 in the cutting block body 28 (FIG. 6), and fed underneath the feed wheel 30. This forms a top strap layer 39. The strap S may or may not be connected to a strap dispenser (not shown).

Figure 3:
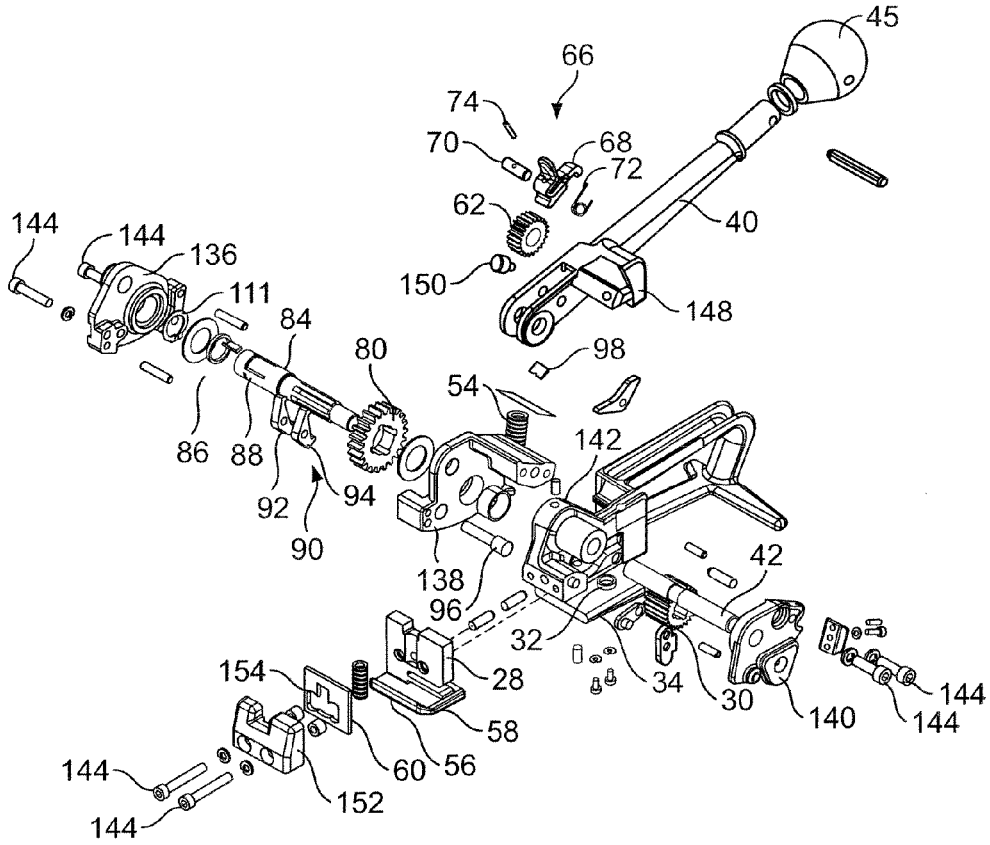
FIG. 3 is an exploded view of the tensioner shown in FIG. 3.

A lever 40 is shown in FIGS. 2 and 3 that is pivotally attached to the base 34 of the tensioner 20 by a pivot pin 42, which is located near a proximal end 44 of the tensioner. A handle or gripping portion 45 of the lever 40 is at a distal end 46 of the lever, which is also near a distal end 48 of the tensioner 20.

The lever 40 may be pressed or turned down in the direction of arrow 47 (e.g., clockwise) and pulled or turned up in the direction of arrow 49 (e.g., counter-clockwise). Pursuant to a first embodiment of the invention, the lever 40 of the tensioner 20 is pressed down, activating a double gear system to begin tensioning the strap S in a clockwise direction around the load L. In other words, the strap S is tensioned or pulled toward a distal end of the lever and tensioner 46, 48, in the direction of arrow 50. According to a second embodiment of the invention, the tensioner 20 incorporates a slack removal system. The slack removal system permits a user to manually pull the strap in the direction of arrow 50 and remove any slack in the strap prior to pressing the lever down.

According to a third embodiment of the invention, a gearbox 52 of the tensioner 20 can be disassembled so that the tension gear 80 and/or the feed wheel 30 are easily accessible. According to a fourth embodiment of the invention, a spring 54 that is used to apply a downward force on the feed wheel 30 and the strap S is positioned outside the gear box 52, reducing the number of parts and complexity of the gear box components.

Figure 6:
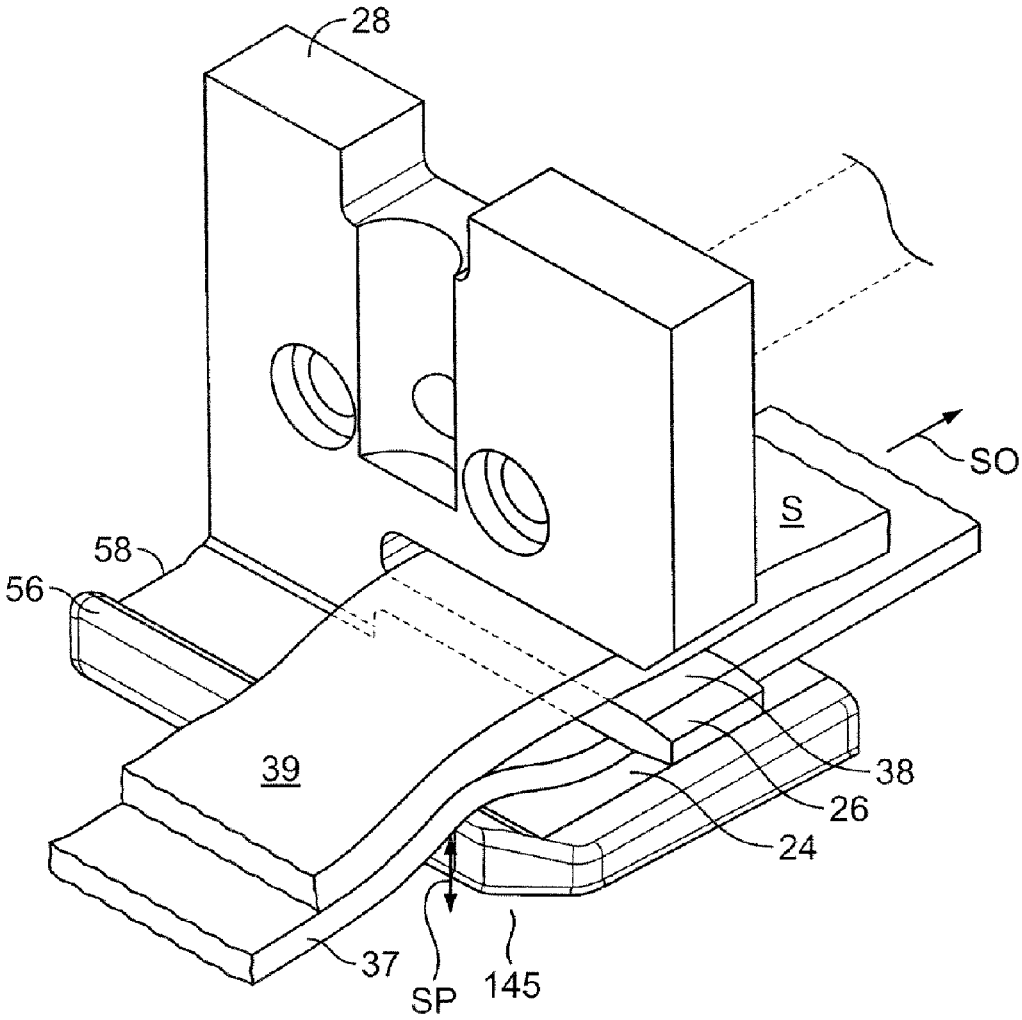

After the strap S is sufficiently tightened around the load L, a sealing tool is typically used to apply a sealing clip 55 to and to bind together the bottom and top strap layers 37, 39. According to a fifth embodiment of the invention, a sealing flange 56 protrudes upward from a cutting block body 58, creating space SP between the load L and the strap S (FIGS. 2 and 6). According to a sixth embodiment of the invention, a cutting blade 60 is positioned by a proximal end 44 of the tensioner 20, and the cutting blade 60 is actuated by turning the lever 40 of the tensioner in the direction of arrow 49. In one embodiment, the lever 40 is turned toward a proximal end 44 of the tensioner 20 a predetermined number of radians until a portion of the lever 40 contacts the cutting blade assembly at a cutting point. The lever is turned beyond the cutting point and urges the cutting blade 60 downward. The blade 60 then cuts the strap S.

Figure 4:
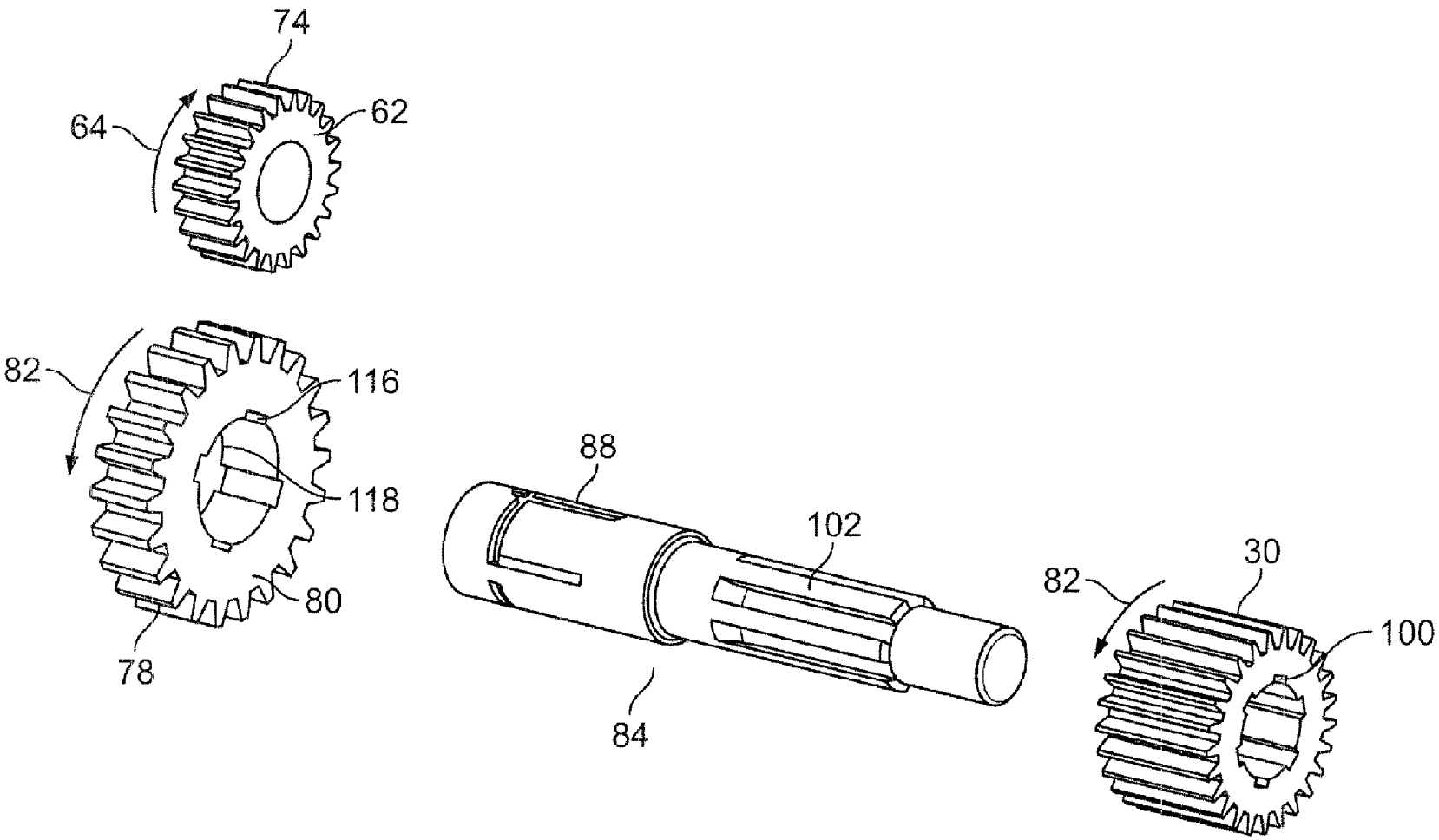
FIG. 4 is an enlarged view of the drive gear, tension gear, shaft, and feed wheel shown in FIG. 3.

FIG. 3 shows a disassembled view of a tensioner incorporating several aspects of the invention. In a first embodiment of the invention, a drive gear 62 is rotatively mounted to the lever 40 so that, when the lever is pressed down (in the direction of arrow 47), the drive gear rotates in a clockwise direction in the direction of arrow 64 (FIG. 4). In a specific embodiment, the drive gear locking mechanism 66 shown in FIG. 4 is used. The drive gear locking mechanism 66 includes a drive pawl 68, pawl pin 70, drive pawl spring 72 and a roll pin 74. The drive gear locking mechanism 66 prevents the drive gear 62 from turning counter-clockwise when, for example, the lever is pulled up, in the direction of arrow 49. Those of skill in the art will appreciate that other types of drive gear locking mechanisms may also be employed.

Figure 5:
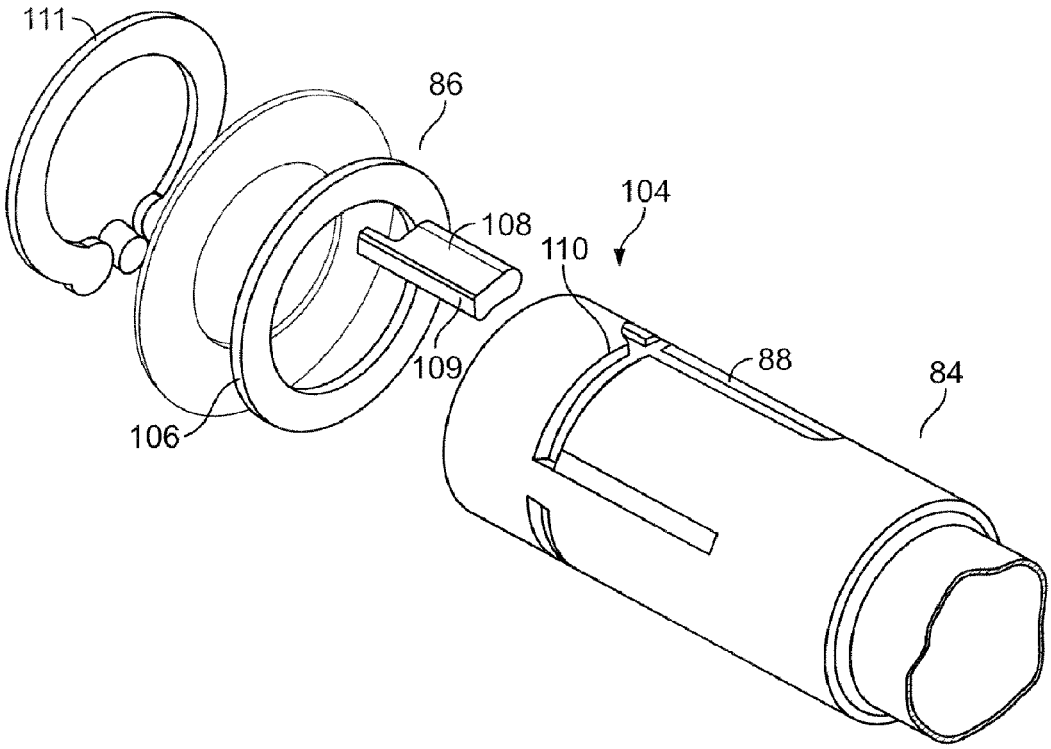
FIG. 5 is an enlarged view of the shaft and pawl-ring shown in FIG. 4.

Teeth 76 of the drive gear 62 are interlocked with teeth 78 of a tension gear 80 so that, when the drive gear 62 rotates clockwise, the tension gear 80 turns counter-clockwise in the direction of arrow 82, as shown in FIG. 5. In one specific embodiment, the tension gear 80 is mounted to a shaft 84 by a pawl-ring assembly 86 that cooperates with shaped grooves 88 formed on the shaft (explained below and shown in FIGS. 3-5). A preferred embodiment includes a tension gear locking mechanism 90. The tension gear locking mechanism 90 includes short and long retaining pawls 92, 94, pawl pin 96, and compression springs 98 that cooperate to prevent the tension gear from turning clockwise. Those of skill in the art appreciate that other types of tension gear locking mechanisms may also be employed.

A tightener, which, in some embodiments is a feed wheel and, in other embodiments, is a windlass, is one of the components used to tighten the strap S around the load L. The embodiments shown in FIGS. 2-6 employ a feed wheel 30, but those of skill in the art will appreciate that other embodiments of the invention (not shown) may employ a windlass.

As shown in FIG. 4, the feed wheel 30 is mounted to the shaft 84 and includes notches 100 that mate with keys 102 on the shaft to secure the feed wheel to the shaft. Thus, when the tension gear 80 turns counter-clockwise (in the direction of arrow 82), so too does the shaft 84 and the feed wheel 30. In sum, the tensioner 20 is activated by pushing the lever 40 down, which causes the drive gear 62 to turn clockwise (in the direction of arrow 64), and the tension gear 80, shaft 84 and feed wheel 30 to turn counter-clockwise (in the direction of arrow 82).

The feed wheel 30 pushes down on the top layer 39 of the strap S, and when the feed wheel turns counter-clockwise, it tensions the strap in a clockwise direction around the load. The strap S is therefore tensioned or pulled toward a distal end of the lever and the tensioner 46, 48 (in the direction of arrow 50), instead of toward a proximal end of the tensioner 44, as is done in prior art tensioners. Prior art tensioners that wind the strap toward a proximal end of the tensioner have a force distribution that tends to "open up" the tensioner. This causes the feed wheel to apply an insufficient downward normal force on the strap, when the strap is tightly wound around the load.

The tensioner of the first embodiment of the invention tensions the strap clockwise around the load L (in the direction of arrow 50), toward the distal end of the lever and the tensioner 46, 48. This allows the tensioner 20 and feed wheel 30 to apply a greater downward normal force on the strap S. Thus, the user need not apply an additional downward force on the tensioner. Strap slippage and milling are also reduced as a result.

Pursuant to a second embodiment of the invention, a selective locking mechanism 104 is employed to permit a user to remove slack from the strap. In particular, a user may manually pull the strap S (toward arrow 50 in FIG. 2) to remove excess slack. This causes the feed wheel 30 and the shaft 84 to turn counter-clockwise (in the direction of arrow 82 in FIG. 4). By employing the selective locking system 104, the tension gear 78 and, thus, the drive gear 76 and lever 30, will not move. This reduces the amount of effort that would be necessary to manually remove slack and permits a user to remove a majority of the slack by simply pulling the strap S. Additional desired tension may be achieved by pushing the lever down a minimal number of times.

In the specific embodiment shown in FIG. 5, the selective locking mechanism 104 includes a pawl-ring assembly 86 and shaped grooves 88 formed on the shaft 84. The pawl-ring assembly 86 includes a ring 106 that pushes the pawl 108 onto the shaft 84. In one embodiment, the ring 106 pushes an end of the pawl 109 against the shaft 84. A tru-arc ring 111 is positioned within a circular groove 110 formed in the shaft 84. The bottom portion 112 of the pawl 108 cooperates with the grooves 88 formed in the shaft 84. The top portion 114 of the pawl 108 remains stationary and interlocks with a notch 116 that is formed within an opening 118 of the tension gear 80 (FIGS. 4-5).

The pawl 108 and grooves 88 are shaped to permit the shaft 84 to move in one direction while the pawl 108 remains stationary with respect to the shaft. Thus, the shaft 84 may move in one direction, while the pawl 108 and, thus, the tension gear 80 remain stationary. The pawl 108 and groove 88 are also shaped so that, when the pawl moves in the opposite direction, it rotates or drives the shaft 84 in the opposite direction. Thus, when the tension gear 80 rotates in the opposite direction (e.g., when it is driven by the drive gear 62), the pawl 108 and shaft 84 also rotate in the opposite direction. The feed wheel 30 moves in the opposite direction as well, since the feed wheel is also mounted to the shaft 84.

Figure 5A:
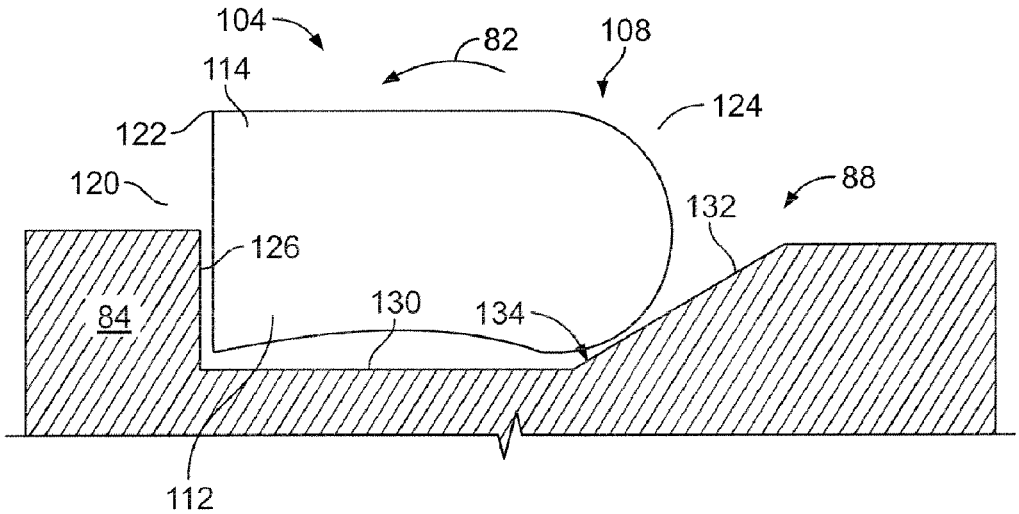
FIG. 5A is a cross-sectional view of the pawl-ring and shaft shown in FIG. 5; and, FIG. 6 is an enlarged view of the cutting block shown in FIG. 4.

FIG. 5A shows a cross-sectional view of one embodiment in which the pawl 108 is positioned within the groove 88 of the shaft 84. The pawl 108 is shaped to have a flat proximal end 120 that forms a top, substantially orthogonal edge 122 at the proximal end and is shaped to have a curved distal end 124. The grooves 88 are defined by a substantially vertical, proximal surface 126 that forms a substantially orthogonal edge 128 with a bottom surface 130 of the groove. A distal surface 132 of the groove 88 forms an obtuse angle 134 with the bottom surface 130.

In this configuration, when the user manually pulls the strap S to remove excess slack, the feed wheel 30 rotates counter-clockwise (in the direction of arrow 82 in FIG. 4) and causes the shaft 84 to also rotate counter-clockwise. When the shaft turns counter-clockwise (in the direction of arrow 82 in FIGS. 4 and 5A), the pawl 108 slides over the distal surface 132 of the groove 88 and remains stationary with respect to the shaft 84. Thus, the tension gear 80, which is interlocked with the pawl 108 by way of the tension gear notch 116, does not rotate; and, neither does the drive gear 62 and lever 40. When the lever 40 is pushed down (in the direction of arrow 47), it rotates the drive gear clockwise (in the direction of arrow 64), and the tension gear 80 is driven in the counter-clockwise direction (arrow 82). The proximal end 120 of the pawl 108 abuts the proximal surface 126 of the groove 88 and drives the shaft 84 and, thus the feed wheel 30, in the counter-clockwise direction (arrow 82).

Those of skill in the art will appreciate that there can be numerous pawl and elongated groove shapes and more than one pawl 108 and/or groove 88. In one embodiment, numerous grooves 88 and four pawls 108 may be used. Those of skill in the art will also appreciate that numerous pawl-ring assemblies are encompassed by the spirit and scope of the invention. For example, other pawl-ring assemblies may incorporate springs.

Pursuant to a third embodiment of the invention shown in FIG. 3, a gear box 52 assembly includes left, middle and right gear box housing members 136,138, 140. The left and middle members 136, 138 are coupled to one another and to a base plate 142 by removable fasteners 144. The base plate 142 extends upwardly from the base 34. The right member 140 is coupled to the middle housing member 138 by removable fasteners 144. The tension gear 80 is housed between the left and middle members 136, 140, and the feed wheel 30 is housed between the right and middle members 140. Easier access to the tension gear and feed wheel is accomplished by allowing a user to disassemble the gear box 52 by removing the removable fasteners 144.

Pursuant to a fourth embodiment of the invention, a spring 54 is used to press the gear box 52 and the feed wheel 30 in a downward direction. As shown in FIG. 3, the spring 54 is positioned outside the gear box 52. Thus, a user need only reposition the spring outside the gear box when disassembling and/or reassembling the gear box, facilitating the disassembly and/or reassembly process. Prior art tensioners incorporated the spring within the gear box, which increased the number of parts and the complexity of the gear box assembly, making gearbox disassembly and/or reassembly cumbersome.

After the strap S is tensioned around the load L, the bottom and top strap layers 37, 39 should be sealed to one another and any excess strapping material should be cut away. A fourth embodiment of the invention shown in FIG. 6 includes a cutting block body 58 having a protruding flange 56 to facilitate sealing. The flange 56 preferably protrudes upward from a proximal end 145 of the body 58. The flange 56 creates space SP between the bottom and top strap layers 37, 39 and the load L. As a result, when a user places the sealing clip 55 atop the top strap layer 39, arms 146 of the clip 55 can depend below the bottom strap layer 37. The user may then easily crimp the arms 146 around the bottom strap 37 and seal the bottom and top strap layers 37, 39 together.

Prior art tensioners do not incorporate a protruding flange, and the upper and lower strap layers therefore lie flush on the load. The arms of the sealing clip often abut edges of the upper and lower strap layers instead of depending below the layers. As a result, the user would often crimp the arms of the sealing clip into the edges of the strap layers (instead of around the bottom strap layer) and crush the strap edges.

After the sealing clip 55 is applied, the user cuts away any excess strap or cuts any portion of the strap still connected to the strap supply or strap dispenser (not shown). Pursuant to a sixth embodiment of the invention, the cutting blade 60 is positioned by a proximal end 44 of the tensioner 20. In one embodiment, the lever 40 includes an extrusion 148 from which protrudes a cutting contact 150. The lever 40 is turned toward the proximal end of the tensioner 44 (in the direction of arrow 49) a predetermined number of radians to reach a cutting point, where the cutting contact 150 touches the cutting blade 60. When the lever 40 is turned beyond the cutting point, the cutting contact 150 urges the blade 60 downward, and the blade 60 cuts the excess strap off.

Because the cutting blade 60 is positioned by the proximal end 44 of the tensioner 20, the user is required to turn the lever 40 toward the proximal end of the tensioner 44 (in the direction of arrow 49), away from the direction (arrow 47) the user pushes on the lever to tighten the strap. As a result, there is less likely to be inadvertent, premature cutting of the strap.

In other specific embodiments, the cutting blade may be a part of a cutting assembly that includes a cutting cover 152, the cutting blade 60, and the cutting block body and plate 58, 28, all of which are fastened together by removable fasteners 144. Those of skill in the art will appreciate that, although six specific embodiments of the invention are disclosed herein, tensioners within the scope and spirit of the invention may incorporate one or more features of the embodiments shown herein.

In the present disclosure, the words "a" or "an" are to be taken to include both the singular and the plural. Conversely, any reference to plural items shall, where appropriate, include the singular.

The word "associated" is used in the claims only to define the environmental elements that the claimed invention acts upon. The claimed invention shall be construed to work only in conjunction with the "associated" environmental elements recited in the claims, and the claimed invention shall not be construed to include any "associated" environmental element as part of the claimed invention itself.

From the foregoing it will be observed that numerous modifications and variations can be made to the invention without departing from the true spirit and scope of the novel concepts of the present invention. It is to be understood that no limitation with respect to the specific embodiments illustrated is intended or to be inferred. The disclosure is intended to cover all such modifications as fall within the scope of the invention.

What is claimed is:

1. A tensioner for applying an associated non-metallic strap around an associated load, the tensioner comprising:

a base;

a lever supported by the base and configured to pivot in a clockwise direction, the lever having a distal end near a distal end of the tensioner;

a drive gear rotatively mounted to the lever and configured to rotate clockwise when the lever is rotated in the clockwise direction;

a tension gear engaging the drive gear and configured to rotate counter-clockwise when the drive gear rotates in a clockwise direction;

a feed wheel coupled to the tension gear and configured to rotate counter-clockwise when the tension gear rotates in a counter-clockwise direction;

a gripper attached to the base, wherein a portion of the associated strap is positioned on and held stationary by the gripper to form a bottom layer, a downstream portion of the associated strap being wrapped around the associated load and fed underneath the feed wheel until it overlies the bottom layer and forms a top layer that is in contact with the feed wheel, wherein, when the lever is rotated in the clockwise direction and the feed wheel rotates counter-clockwise, the top layer is pulled toward a distal end of the tensioner and the associated strap is tensioned in a clockwise direction around the associated load.

2. The tensioner of claim 1, further comprising a gear box, the gear box including left and middle housings that are removably fastened to one another, wherein the tension gear is positioned between the left and middle housings.

3. The tensioner of claim 2, further comprising a spring, wherein the spring is positioned on the outside of the gear box and is positioned between the gear box and the base.

4. The tensioner of claim 1, further comprising a middle housing and a right housing that are removably fastened to one another, the feed wheel being positioned between the middle housing and the right housing.

5. The tensioner of claim 1, further comprising a cutting block having a flange formed on a proximal end of the cutting block and protruding upward, the cutting block being connected to the base.

6. The tensioner of claim 1, further comprising a cutting blade positioned by a proximal end of the tensioner and connected to the base.

7. The tensioner of claim 6, wherein the lever further comprises a cutting contact coupled thereto, the lever reaching a cutting point when the lever is rotated a predetermined number of radians in a counter-clockwise direction, and the cutting contact touching the cutting blade at the cutting point and urging the cutting blade downward when the lever is rotated counter-clockwise beyond the cutting point.

8. The tensioner of claim 1, further comprising a selective locking mechanism and a shaft that couples the feed wheel and the tension gear to one another, the feed wheel and shaft rotating counter-clockwise when a user pulls the associated strap toward the distal end of the tensioner and the selective locking system preventing the tension gear from rotating.

9. The tensioner of claim 8, wherein the selective locking mechanism further comprises grooves formed in the shaft and a pawl-ring assembly including a ring that presses the pawl against the shaft, wherein the tension gear includes an opening formed therein to receive the shaft and a notch formed within the opening, the notch shaped to receive a top portion of the pawl, wherein the groove and the pawl are shaped so that the groove can receive a bottom portion of the pawl and so that the pawl can move out of the groove when the pawl-ring rotates in one direction and so that the pawl cannot move out of the groove when the pawl-ring rotates in a second direction that is opposite the first direction.

10. A tensioner with a cutter for applying an associated non-metallic strap around an associated load and for cutting an unused portion of the associated strap, the tensioner comprising:

a base;

a lever supported by the base and configured to pivot, the lever further including a cutting contact;

a gear rotatively mounted to the lever and configured to rotate when the lever is turned in a first direction;

a tightener coupled to the gear and configured to rotate when the gear rotates;

a feed wheel coupled to the tightener and configured to rotate when the tightener rotates;

a cutting blade positioned by a proximal end of the tensioner and connected to the base, the cutting contact touching the cutting blade at a cutting point when the lever is rotated a predetermined number of radians in a second direction that is opposite to the first direction, wherein the cutting contact urges the cutting blade downward when the lever is rotated in the second direction beyond the cutting point;

a gripper attached to the base, wherein a portion of the associated strap is positioned on and held stationary by the gripper, a downstream portion of the associated strap being wrapped around the associated load and fed to the tightener, wherein the downstream portion of the associated strap is fed underneath the feed wheel, wherein, when the lever is turned in the first direction, the associated strap is tensioned around the associated load.

11. The tensioner of claim 10, further comprising a cutting block including a flange formed on a proximal end of the cutting block and protruding upward, the cutting block being connected to the base.

12. The tensioner of claim 10, wherein the tightener further comprises a windlass, wherein the downstream portion of the associated strap is fed into the windlass.

13. A tensioner with a cutter for applying an associated non-metallic strap around an associated load and for cutting an unused portion of the associated strap, the tensioner comprising:

a base;

a lever supported by the base and configured to pivot;

a gear rotatively mounted to the lever and configured to rotate when the lever is turned in a first direction;

a tightener coupled to the gear and configured to rotate when the gear rotates;

a feed wheel coupled to the tightener configured to rotate when the tightener rotates;

a cutting block including a flange formed on a proximal end of the cutting block and protruding upward, the cutting block being connected to the base;

a gripper attached to the base, wherein a portion of the associated strap is positioned on and held stationary by the gripper, a downstream portion of the associated strap being wrapped around the associated load and fed to the tightener, wherein the downstream portion of the associated strap is fed underneath the feed wheel, and wherein, when the lever is turned in the first direction, the associated strap is tensioned around the associated load.

14. The tensioner of claim 13, further comprising a cutting blade positioned by a proximal end of the tensioner and connected to the base, wherein the lever includes a cutting contact coupled thereto, the cutting contact touching the cutting blade at a cutting point when the lever is rotated a predetermined number of radians in a second direction that is opposite to the first direction, wherein the cutting contact urges the cutting blade downward when the lever is rotated in the second direction beyond the cutting point.

15. The tensioner of claim 13, wherein the tightener further comprises a windlass, wherein the downstream portion of the associated strap is fed into the windlass.

16. A tensioner for applying an associated non-metallic strap around an associated load, the tensioner comprising:

a base;

a lever supported by the base and configured to pivot in a clockwise direction, the lever having a distal end near a distal end of the tensioner;

a drive gear rotatively mounted to the lever and configured to rotate clockwise when the lever is rotated in the clockwise direction;

a tension gear engaging the drive gear and configured to rotate counter-clockwise when the drive gear rotates in a clockwise direction, the tension gear having an opening formed therein and a notch formed within the opening;

a pawl-ring assembly including a ring that presses a pawl against a shaft, a top portion of the pawl configured to cooperate with the notch;

the shaft, the shaft receiving the tension gear and coupling a feed wheel to the tension gear, wherein the shaft has a shaped groove formed therein, the shaped groove receiving a bottom portion of the pawl, wherein the shaped groove and the pawl are shaped so that the pawl can move out of the groove when the shaft rotates in a first direction and so that the pawl cannot move out of the groove when the pawl-ring rotates in a second direction that is opposite the first direction;

the feed wheel coupled to the tension gear and configured to rotate counter-clockwise when the tension gear rotates in a counter-clockwise direction;

a gripper attached to the base, wherein a portion of the associated strap is positioned on and held stationary by the gripper to form a bottom layer, a downstream portion of the associated strap being wrapped around the associated load and fed underneath the feed wheel until it overlies the bottom layer and forms a top layer that is in contact with the feed wheel, wherein, when the lever is rotated in the clockwise direction and the feed wheel rotates counter-clockwise, the top layer is pulled toward a distal end of the tensioner and the associated strap is tensioned in a clockwise direction around the associated load.

17. The tensioner of claim 16, further comprising a base plate extending vertically from the base and a gear box, the gear box including left, middle, and right housings, the base plate and the left, middle and right housings being removably fastened to one another, wherein the tension gear is positioned between the left and middle housings and the feed wheel is positioned between the middle and right housings.

18. The tensioner of claim 16, further comprising a spring, wherein the spring is positioned on the outside of the gear box and is positioned between the gear box and the base.

19. The tensioner of claim 16, wherein the groove is defined by a vertical proximal end that forms a substantially orthogonal edge with a bottom surface of the groove and a distal end that forms an obtuse angle with the bottom surface, and wherein the pawl is defined by a vertical proximal end and a curved distal end.

* * * * *

UNITED STATES PATENT AND TRADEMARK OFFICE

CERTIFICATE OF CORRECTION

PATENT NO. : 7,455,080 B2
APPLICATION NO. : 11/307180
DATED : November 25, 2008
INVENTOR(S) : Crittenden et al.

It is certified that error appears in the above-identified patent and that said Letters Patent is hereby corrected as shown below:

Claim 10, Column 10, Lines 38-39 should read, "tightener, wherein the downstream portion of the associated strap is fed underneath the feed wheel, and wherein,"

Signed and Sealed this

Seventeenth Day of February, 2009

John Doll

JOHN DOLL
*Acting Director of the United States Patent and Trademark Office*